US005737887A

United States Patent [19]

Smeenge

[11] Patent Number: 5,737,887

[45] Date of Patent: Apr. 14, 1998

[54] WALL PANEL ASSEMBLY

[75] Inventor: Paul Allen Smeenge, Ada, Mich.

[73] Assignee: American Seating Company, Grand Rapids, Mich.

[21] Appl. No.: 778,162

[22] Filed: Jan. 10, 1997

[51] Int. Cl.[6] ..... E04B 1/38

[52] U.S. Cl. ..... 52/282.2; 52/280; 52/281; 52/656.9; 160/135

[58] Field of Search ..... 52/279, 277, 280, 52/281, 282.1, 282.2, 474, 481.2, 656.9, 732.1, 287.1, 220.1, 220.7; 403/329, 326, 401; 100/135

[56] References Cited

U.S. PATENT DOCUMENTS

| | | | |
|---|---|---|---|
| 3,585,768 | 6/1971 | Klein | 52/282.2 X |
| 4,123,879 | 11/1978 | Blodee et al. | 52/36 |
| 4,265,502 | 5/1981 | Blodee et al. | 312/109 |
| 4,585,131 | 4/1986 | Crossman et al. | 52/287.1 X |
| 5,039,177 | 8/1991 | Newell et al. | 52/287.1 X |

FOREIGN PATENT DOCUMENTS

| | | | |
|---|---|---|---|
| 1028791 | 5/1953 | France | 52/282.2 |
| 2138292 | 2/1973 | Germany | 52/280 |
| 2258006 | 5/1974 | Germany | 52/281 |
| 2319929 | 11/1974 | Germany | 52/281 |

OTHER PUBLICATIONS

American Seating "Installation and Assembly Instructions" pp. 0–40, dated Jun. 29, 1988.

*Primary Examiner*—Creighton Smith

*Attorney, Agent, or Firm*—Young & Basile, P.C.

[57] ABSTRACT

A wall panel assembly for use in providing an open plan system to define separate areas. An L shaped connector bracket is utilized to join two panels together in an L configuration, three panels together in a T configuration, or four panels together in an X configuration. In each case one leg of the bracket is secured to an end edge of the first wall panel and the other leg of the bracket is secured to the end edge of a second panel. Where only two panels are being joined in an L configuration, a ball end edge of an L shaped trim post is positioned at one end edge in a socket groove defined by the connector bracket and rotated to bring another ball end edge of the trim panel into snapping coaction with a socket groove defined on another end edge of the connector bracket. Where three panels are to be joined in a T configuration, the second and third panels are joined by further connector brackets spaced vertically from the connector brackets joining the first and second panels and a ball end edge of a generally planar trim post is positioned in socket grooves defined by the connector bracket joining the first and second panels, whereafter the post is rotated to bring another ball end edge of the trim post into snapping engagement with socket grooves defined on the connector brackets connecting the second and third panels.

18 Claims, 12 Drawing Sheets

FIG-6
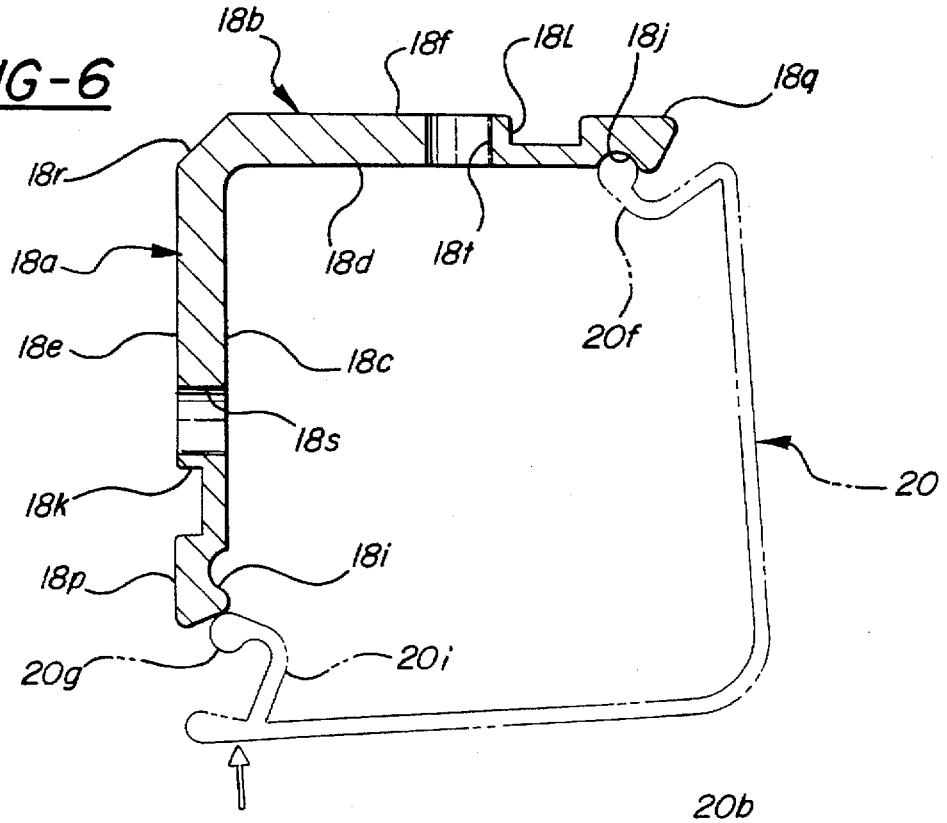
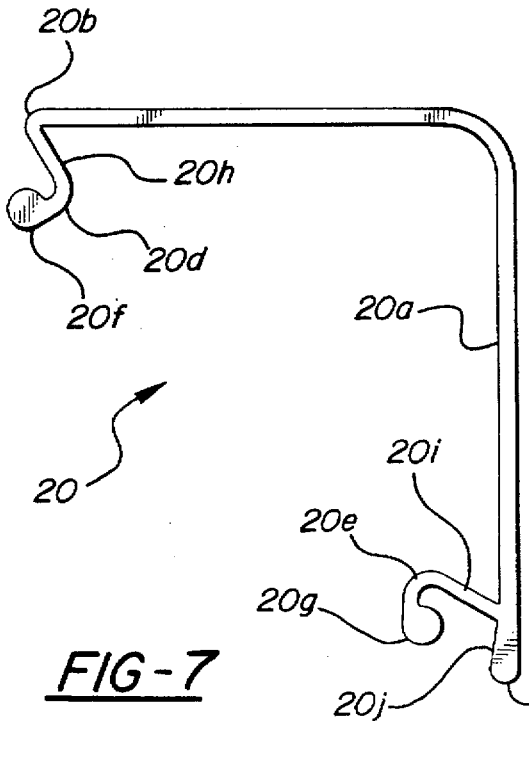
FIG-7
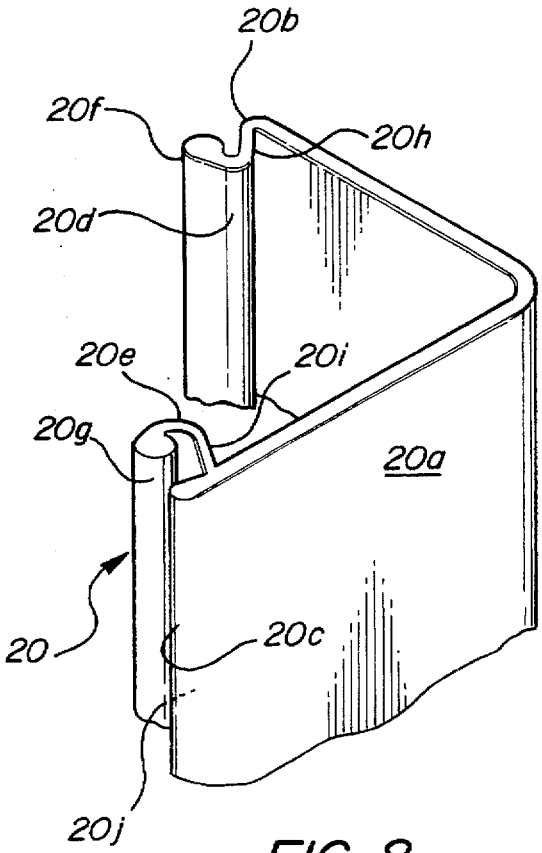
FIG-8

10
12
14
18
22
22f
22g
22i
28
30
32a
42
54
68

WALL PANEL ASSEMBLY

BACKGROUND OF THE INVENTION

This invention relates to wall panel assemblies and more particularly to a connector assembly for use in releasably attaching upstanding wall panels together in various configurations.

Separate or modular wall panels have particular utility in "open plan" offices and schools. Open plan systems do not use conventional floor to ceiling walls to separate rooms but, rather, individual wall panels are selectively ganged together to define desired areas. The height of the wall panels may vary, for example, in the range of 5 to 7 feet and the widths may vary in the range of 18 to 48 inches. Such panels need not be secured to the floor and typically terminate short of the ceiling.

Open plan office and school systems have received increased acceptance during recent years because of the ease of construction, relatively low cost, and flexibility. Whereas the existing wall panels are generally satisfactory, the connector assemblies utilized to secure the wall panels together in various relative configurations tend to be rather complex resulting in large inventory requirements. Further, the connector assemblies tend to plug the vertical passages between the end edges of the coupled together panels with the result that it is difficult to route the ever increasing power lines and telecommunication lines between the panels.

SUMMARY OF THE INVENTION

The invention in directed to the provision of a simplified connector assembly for use in releasably attaching upstanding wall panels together in various relative configurations.

The invention connector assembly includes a set of upper and lower connector brackets each having an L configuration defining first and second leg portions adapted for respective attachment to vertical end edges of first and second wall panels arranged in an L configuration. Each leg portion has an inside face and an outside face and defines a free vertical end edge and each leg portion defines a vertical socket groove proximate the free end edge of the leg portion opening in the inside face of the leg portion. The connector assembly further includes a further connector member having a vertically elongated main body portion defining vertical edges and a vertical flange portion at each edge of the main body portion with each flange portion defining a ball end edge sized to fit in a socket groove of the connector brackets. With this connector assembly construction, the upper and lower connector brackets may be secured to a vertical end edge of the juxtaposed first and second wall panels and the ball end edges of the further connector member may be utilized in coaction with the socket grooves of the connector brackets to complete the connection of the first and second wall panels.

If the first and second wall panels are to be joined together to provide an L panel configuration, the further connector member comprises a vertical trim post of L cross-sectional configuration sized to position the respective ball end edges in the respective vertical socket grooves of the connector brackets. With this arrangement, the further connector member coacts with the connector brackets to define a clear vertical passage proximate the end edges of the first and second wall panels permitting the free passage of power wires and telecommunication wires.

Where a third wall panel is to be joined to the first and second wall panels to form a T configuration, the assembly further includes a second set of upper and lower connector brackets intended for attachment to a vertical end edge of the second wall panel and a vertical end edge of the third wall panel with the first set of connector brackets positioned at a different vertical height on the vertical end edge of the second wall panel than the second set of connector brackets. In this combination, the further connector assembly comprises a generally planar vertical trim post sized to allow the ball end edges of the flange portions of the post to fit respectively in socket grooves in the leg portions of the first set of connector brackets and in socket grooves in the leg portions of the second set of connector brackets. With this arrangement, the vertical end edges of the first, second and third wall panels coact with the planar vertical trim post to define a clear vertical passage between the juxtaposed panels for the passage of power wires and telecommunication wires.

When a fourth panel is to be joined to the first, second and third panel to form an X configuration, the further connector assembly member comprises a retainer bracket for attachment to the end edge of the fourth panel with the ball end edges of the flange portions of the retainer bracket seated respectively in socket grooves in the leg portions of the first set of connector brackets attached to the end edge of the first panel and in socket grooves in the leg portions of the second set of connector brackets attached to the end edge of the third panel. This arrangement allows the four panels to be attached together in an X configuration with a clear vertical passage between the juxtaposed end edges of the panels for the passage of electrical equipment.

According to a further feature of the invention, each leg portion of each connector bracket further includes a vertical hinge groove in the outside face of the leg portion inboard of the socket groove. The vertical hinge groove defines a vertical hinge portion inboard of the socket groove to allow flexing of the outboard end edge of the leg portion to facilitate entry of a ball end edge of a flange portion of a further connector member into the respective socket groove with a snap action.

According to a further feature of the invention, the vertical flange portion of the further connector assembly member is connected to the main body portion of the further connector assembly member by a hinge portion to facilitate flexing of the flange portion relative to the main body portion to further facilitate the snapping coaction between the ball end edges of the further connector member and the socket grooves of the connector brackets. The snapping coaction is best achieved by positioning one ball end edge of the further socket connector member in the socket grooves of one set of connector brackets and thereafter rotating the further connector member to bring the other ball end edge of the connector member into snapping coaction with the socket grooves of another set of connector brackets.

The wall panel comprises a frame structure and front and rear panel inserts supported by the frame structure. The frame structure includes a vertical tube member defining a vertical end edge wall and spaced front and rear side walls. A series of vertically spaced slots are provided in the front and rear side walls of the vertical tube member for supporting shelving in adjustable positions on the wall panel with the slots, in the absence of mounted shelving, permitting sight through the vertical tube from a region in front of the wall panel to a region behind the wall panel. A vertically extending sight barrier member is secured to an inner face of the vertical end edge wall of the tube member and is positioned between the slots in the front side wall and the slots in the rear side wall so as to provide a barrier preventing sight through the tube through the front and rear slots.

According to a further features of the invention, a series of vertically spaced apertures are provided in the end edge wall of the tube member for self-tapping engagement with the screw shaft of a self-tapping screw, and the sight barrier member defines front and rear vertical walls positioned on opposite sides of the series of spaced apertures in the end edge wall and spaced transversely by a distance less than the thickness of the screw shaft portion of the self-tapping screw. With this arrangement, the connector brackets may be secured to the outer face of the vertical end edge wall by passing a self-tapping screw through apertures in the bracket for self-tapping engagement with an aperture in the vertical end edge wall followed by self-tapping engagement with the front and rear walls of the barrier member.

In the disclosed embodiment of the invention, the sight barrier member has a hat shaped cross-sectional configuration including a brim structure defining front and rear flanges for attachment to the inner face of the vertical end edge wall and a crown structure defining spaced front and rear vertical side walls constituting the side walls of the barrier member and a transverse bight portion interconnecting the side walls of the crown structure. With this construction, the advancing screw shaft may self-tap through the aperture in the end edge wall of the tube member, thereafter self-tap along the spaced side walls of the crown structure, and thereafter pierce a hole in the bight portion of the crown structure and proceed self-tappingly through the pierced hole.

The invention further teaches a methodology for releasably assembling wall panels in various configurations utilizing the previously described upper and lower connector brackets in association with the further assembly members.

BRIEF DESCRIPTION OF THE DRAWINGS

FIG. 4 is a cross-sectional view taken on line 4—4 of FIG. 3;

FIGS. 5 and 6 are perspective and cross-sectional views respectively of a connector bracket employed in the invention wall panel assembly;

FIGS. 7 and 8 are plan and perspective views respectively of a trim post employed in the invention wall panel assembly;

DETAILED DESCRIPTION OF THE PREFERRED EMBODIMENT

Figure 1:
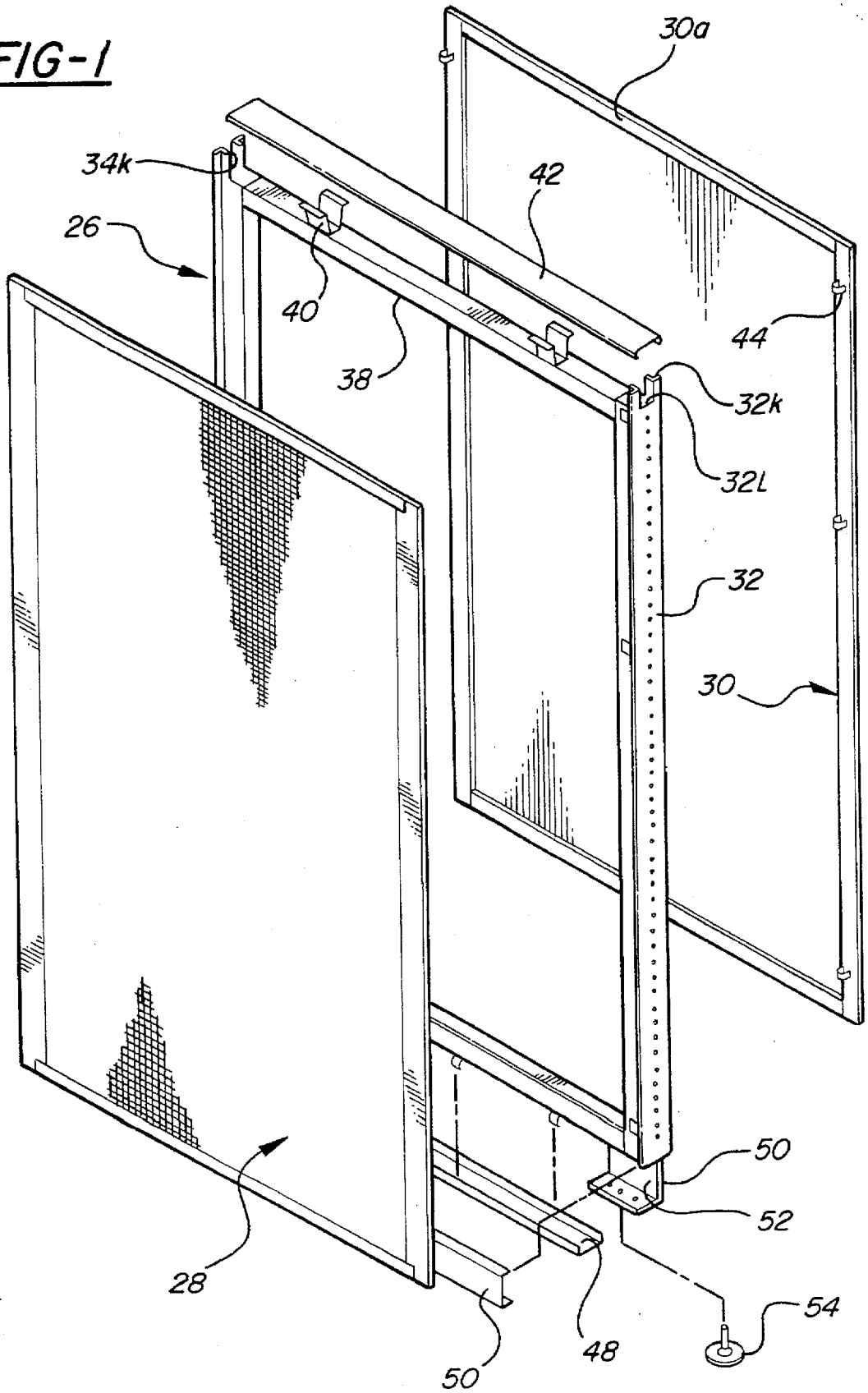
FIG. 1 is an exploded perspective view of a wall panel according to the invention.
Figure 3:
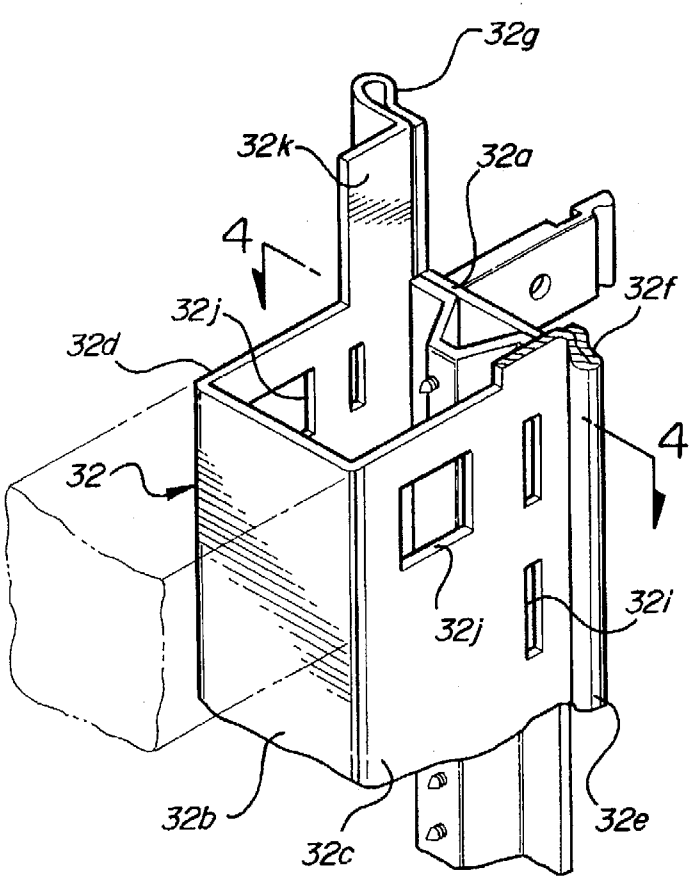
FIG. 3 is a fragmentary detail view of the wall panel.
Figure 2:
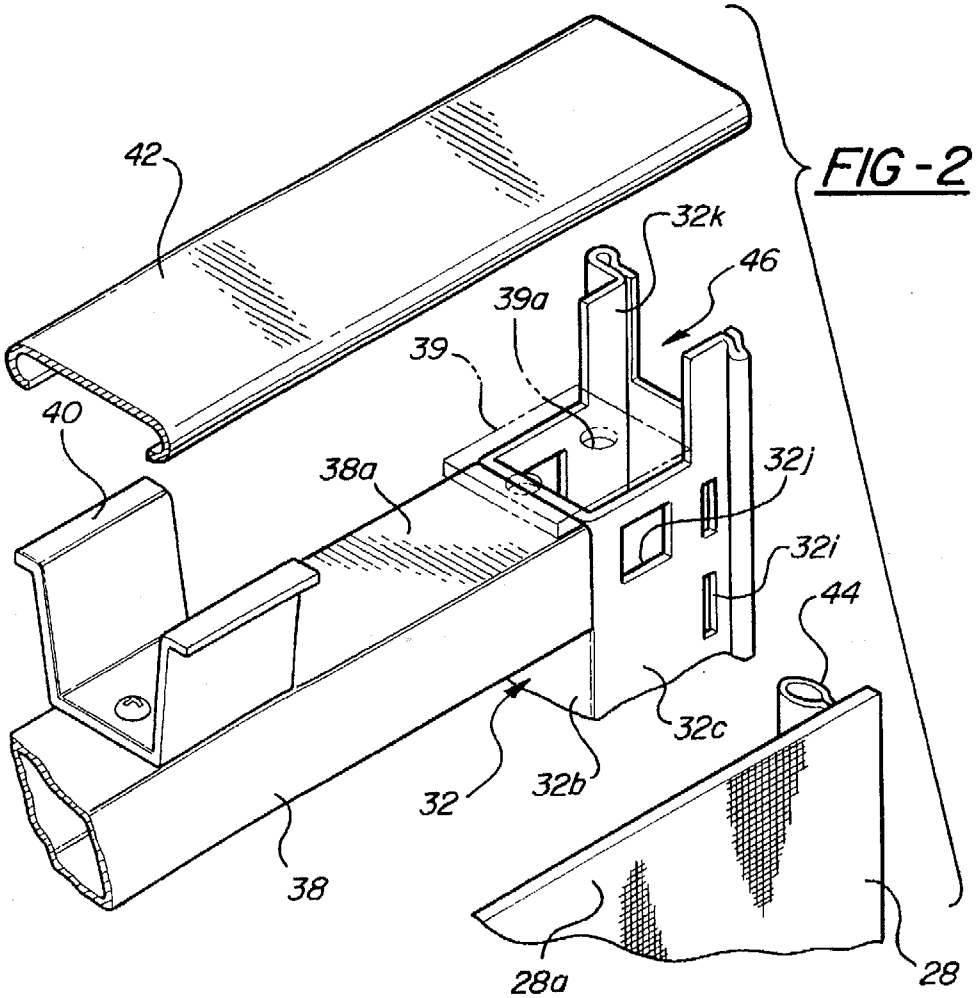
FIG. 2 is a fragmentary perspective exploded view of the wall panel.
Figures 4, 5:
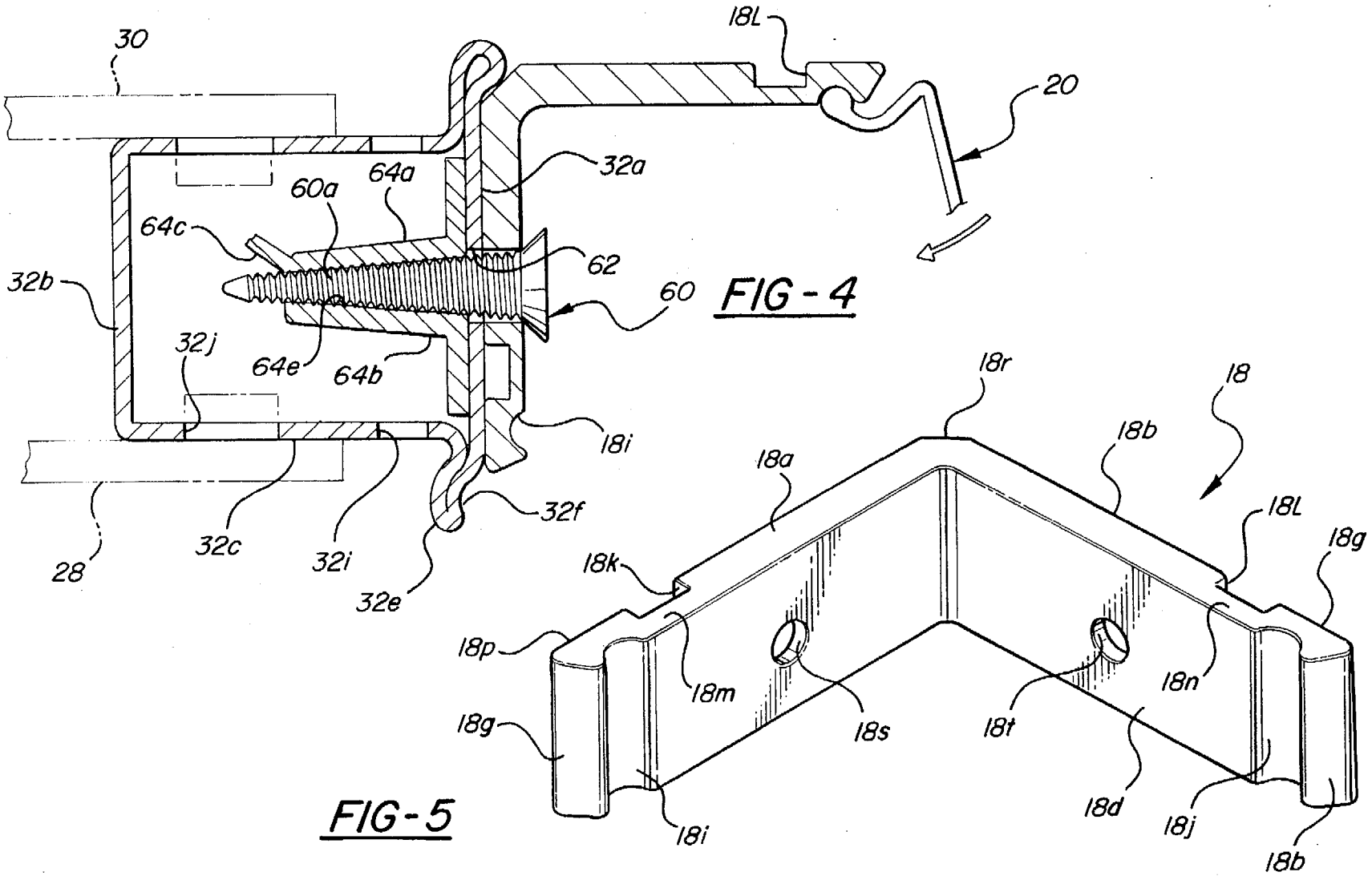

The wall panel assembly of the invention, broadly considered, includes first, second, third and fourth wall panels 10, 12, 14 and 16; connector brackets 18; trim posts 20 and 22; and retainer brackets 24.

First wall panel 10 (FIGS. 1–4) includes a framework 26, a front insert 28 and a rear insert 30. Framework 26 has a rectangular tubular configuration and includes an inboard tube 32, an outboard tube 34, a lower tube 36, and an upper tube 38 suitably secured together in a welding operation.

Inboard tube 32 includes an inboard wall 32*a*, an outboard wall 32*b*, and spaced front and rear side walls 32*c*, 32*d*. Front side wall 32*c* is joined to inboard wall 32*a* via a fold 32*e* defining a concave surface 32*f*, and rear wall 32*d* is joined to inboard wall 32*a* via a fold 32*g* defining a convex surface 32*h* which is generally complementary to concave surface 32*f*. A series of vertically elongated and vertically spaced slots 32*i* are provided in front wall 32*c* proximate fold 32*e* and a plurality of vertically spaced apertures 32*j* are provided in wall 32*c* outboard of slots 32*i*. Similarly, slot 32*i* and apertures 32*j* are provided in rear wall 32*d*. It will be understood that slots 32*i* are utilized to receive brackets for hanging shelving or other equipment on the front or rear faces of the wall panel. The upper ends of side walls 32*c* and 32*d* are selectively configured to define pillars 32*k*. A tapping plate 39 is welded to the upper end of tube 32 and defines spaced apertures 39*a*. Outboard tube 34 is identical to inboard tube 32 including the provision of a tapping plate 39 at the upper end of the tube. A plurality of horizontally spaced retainer clips 40 are secured to the upper wall 38*a* of upper tube 38 for snapping coaction with a top cap 42. In assembled relation, top cap 42 is snappingly positioned on the upper ends of retainer clips 40 and is seated at its opposite ends on top of pillars 32*k*, 34*k*.

Front insert 28 has a layered fabric and board construction and has a rectangular configuration having a size conforming to the size of framework 26. Insert 28 is snappingly secured to framework 26 via spring clips 44 secured to the inner face of the insert which snappingly coact with framework apertures 32*j* to removably secure the insert to the framework.

Rear insert 30, similarly, has a layered fabric and board construction and includes spring clips 44 for snapping coaction with the apertures 32*j* in inboard and outboard tubes 32 and 34. With the inserts snappingly secured to the framework, the upper edge portions 28*a*, 30*a* of the inserts coact with the top cap 42 and with the upper wall 38*a* of upper tube 38 to define a corridor or pathway 46 extending along the upper edge of the wall panel beneath the top cap 42 and above top wall 38*a*. It will be understood that pathway 46 is sized and configured to readily accommodate telecommunications lines or the like. It will be seen that the front wall 32*a* of inboard tube 32 is cutaway at 321 to accommodate the pathway and that the inner tube 26 is similarly cutaway to further accommodate the pathway. It will further be understood that even with inserts 28 and 30 in place, slots 32*i* are exposed to allow brackets to access the slots to allow the mounting of various items of shelving, furniture or equipment on the front or rear faces of the panel.

Wall panel 10 further includes a bottom plate 48 and front and rear face plates 50 which coact with the lower face of lower tube 36 to define a lower pathway or corridor 52 running along the bottom of the panel to accommodate power cables or the like. The wall panel further includes levelers 54 threadingly engaging bottom plate 48 to selectively adjust the height of the wall panel above the floor surface.

It will be understood that the second, third, and fourth wall panels 12, 14 and 16 are identical to wall panel 10 and are accordingly illustrated with like reference numerals identifying the various components of the wall panel.

Each connector bracket 18 (FIGS. 5 and 6) has an L Configuration including first and second leg portions 18*a* and 18*b*. Each leg portion has an inside face 18*c*, 18*d* and an outside face 18*e*, 18*f* and each leg portion defines a free vertical end edge 18*g*, 18*h*. Each leg portion further defines a vertical socket groove 18*i*, 18*j* proximate the free end edge of the leg portion opening in the inside face of the leg portion and a vertical hinge groove 18*k*, 18*l* in the outside face of the respective leg portion inboard of the socket groove. Hinge grooves 18*k*, 18*l* define hinge sections 18*m*, 18*n* inboard of the respective socket grooves to allow flexing of the outboard edges of the leg portions. The outer faces 18*p*, 18*q* of end edge portions 18*g*, 18*h* are inset with respect to the outer faces of the main body portions of the leg portions to facilitate the flexing action of the end edge portions. Leg portions 18*a* and 18*b* are joined at their outer surfaces by a beveled surface 18*r* and each leg portion defines an aperture 18*s*, 18*t* inboard of the respective hinge groove 18*k*, 18*l*.

Trim post 20 (FIGS. 7 and 8) has an L shaped configuration and has a length or height approximating the combined vertical height of tube 32 and face plates 50. Post 20 specifically includes an L shaped main body portion 20*a* defining vertical end edges 20*b* and 20*c* and a vertical flange portion 20*d*, 20*e* at each edge of the main body portion. Each flange portion in turn defines a ball end edge 20*f*, 20*g* having a generally circular cross-sectional configuration designed to fit rotatably or swively in a respective socket groove 18*i*, 18*j* of a connector bracket. Trim post 20 further defines hinge portions 20*h*, 20*i* connecting the flange portions 20*d*, 20*e* to main body portion 20*a* to facilitate flexing of the flange portions and thereby the ball end edges relative to the main body portion of the trim post. Hinge portion 20*h* extends directly from end edge 20*b* whereas hinge portion 20*i* intersects the main body portion at a location inboard of end edge 20*c* to define an extension portion 20*j* outboard of hinge portion 20*i*.

Figure 9:
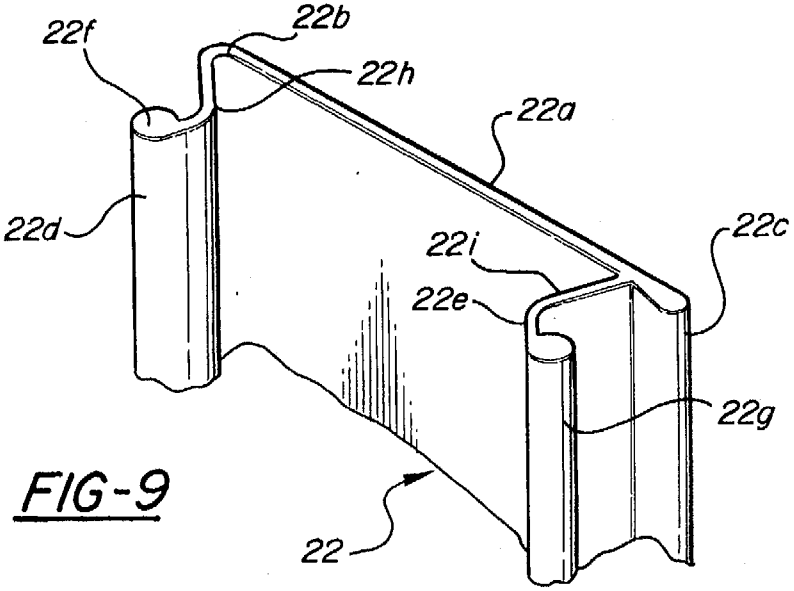
FIGS. 9 and 10 are perspective and plan views respectively of a further trim post employed in the invention wall panel assembly.
Figure 10:
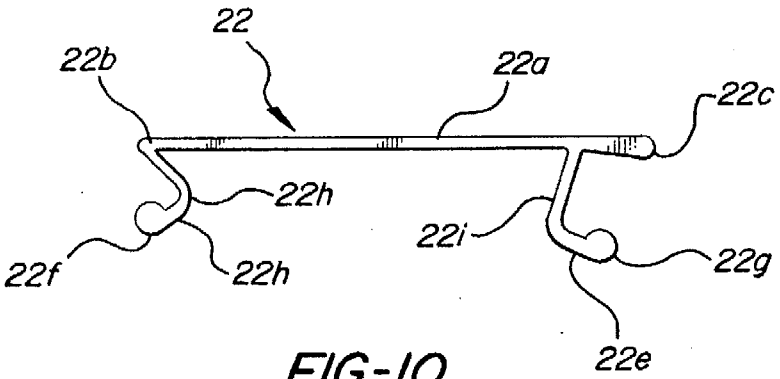

Trim post 22 (FIGS. 9 and 10) has a generally planar configuration and has a length or height approximating the combined vertical height of tube 32 and face plates 50. Post 22 specifically includes a planar main body portion 22*a* defining vertical edges 22*b*, 22*c* and vertical flange portions 22*d*, 22*e* proximate each vertical edge of the main body portion. Each flange portion in turn defines a ball end edge 22*f*, 22*g* having a circular cross-sectional configuration sized to fit rotatably or swively in a respective socket groove 18*i*, 18*j* of a connector bracket. Trim post 22 further includes hinge portions 22*h*, 22*i* connecting the flange portions 22*d*, 22*e* to the main body portion 22*a* to allow flexing of the flange portions and thereby the end edges relative to the main body portion. Hinge portion 22*h* connects directly with end edge 22*b* but hinge portion 22*i* connects with the main body portion 22*a* at a location on the main body portion inboard of vertical edge 22*c* so as to define an extension portion 22*j* outboard of hinge portion 22*i*.

Figure 11:
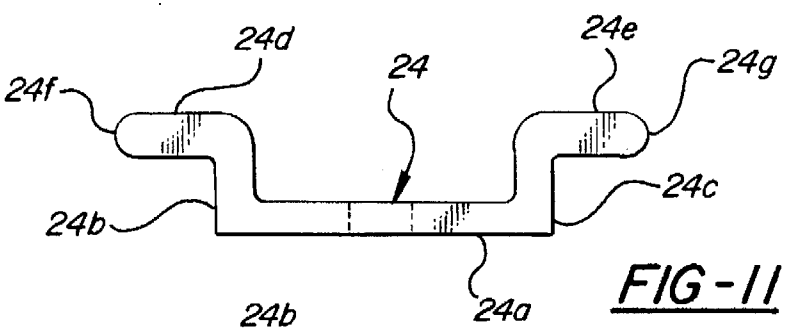
FIGS. 11 and 12 are plan and perspective views respectively of a retainer bracket employed in the invention wall panel assembly.
Figure 12:
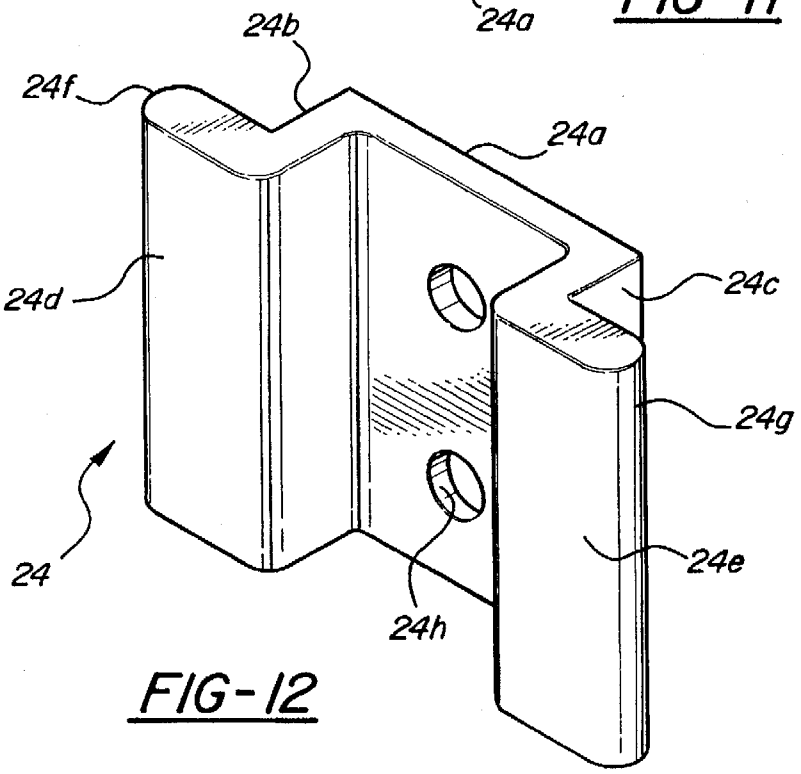

Retainer bracket 24 (FIGS. 11 and 12) includes a planar main body portion 24*a*, defining vertical edges 24*b*, 24*c*, and vertical flange portions 24*d*, 24*e*. Each vertical end edge of each flange portion in turn defines a ball end edge 24*f*, 24*g* sized to fit rotatably or swively in a socket groove of the connector bracket.

The manner in which the connector assembly members 18, 20, 22 and 24 are collectively utilized to provide various wall panel configurations is illustrated in FIGS. 13–28. Specifically, the assembly of two wall panels in an L configuration is illustrated in FIGS. 13–16; the assembly of three wall panels in a T configuration is illustrated in FIGS. 17–22; and the assembly of four wall panels in an X configuration is illustrated in FIGS. 23–28.

Figure 13:
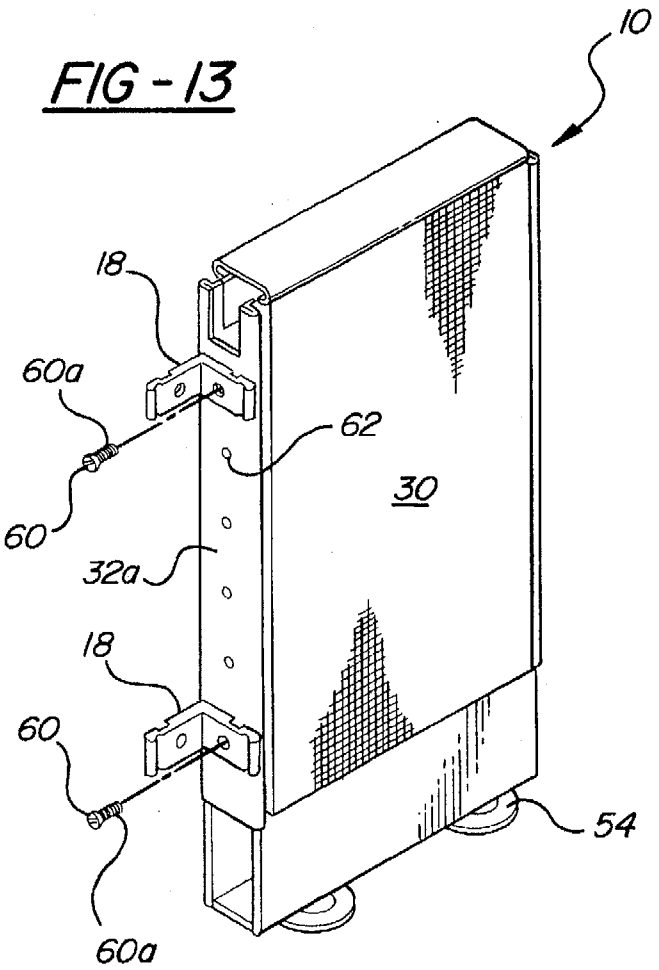
Figure 29:
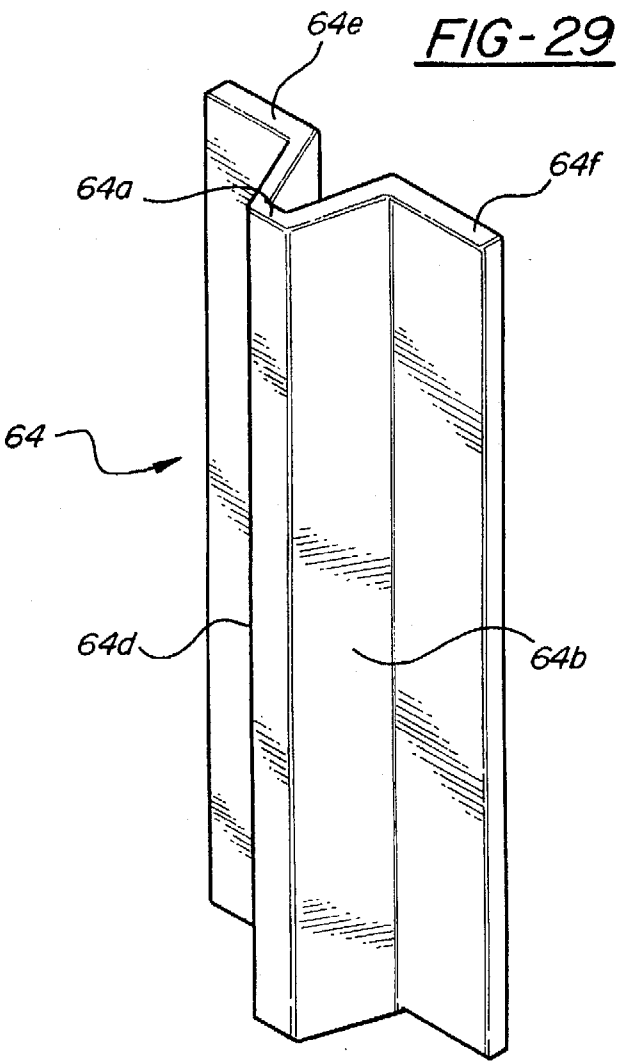
FIG. 29 is a perspective view showing a sight barrier member employed in the invention wall panel assembly.
Figure 28:
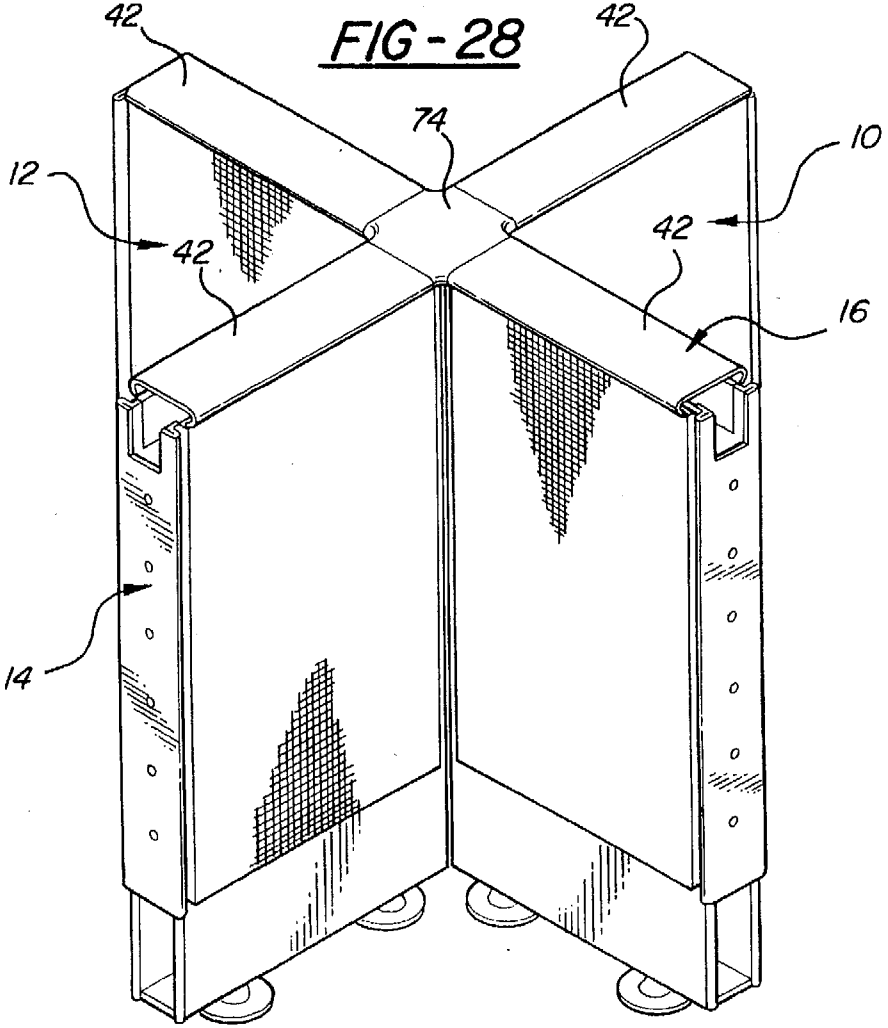

With reference to FIG. 13, upper connector bracket 18 is secured to inboard wall 32*a* of first wall panel 10 utilizing a self-tapping screw 60 which passes through aperture 18*t* in leg portion 18*f* for self-tapping engagement with the upper hole of a series of holes 62 punched in the inboard wall 32*a*. After passing through hole 62 in a self-tapping fashion, the screw self-tappingly engages opposite side walls 64*a*, 64*b* of a sight barrier member 64 (FIGS. 3, 4 and 29) and thereafter punches out a flap 64*c* in the end or bight portion 64*d* of the sight barrier member to form an aperture 64*e* in bight portion 64*d* through which the screw shaft self-tappingly proceeds. Sight barrier member 64 (which functions in the absence of mounted shelving to block sight through the tube via front and rear slots 32*i*) has a hat shaped cross-sectional configuration including a brim structure defining front and rear flange portions 64*e*, 64*f* for welding attachment to the inner face of tube wall 32*a* and a crown structure defining the spaced front and rear vertical side walls 64*a*, 64*b* and the bight portion 64*d*. It will be understood that the apertures 62 in the front wall 32*a* as well as the apertures 64*e* punched in the bight portion 64*d* of the sight barrier member have a diameter less than the diameter of the shaft 60*a* of the self-tapping screw and that the side walls 64*a*, 64*b* are spaced transversely by a distance less than the thickness of the screw shaft 60*a*. Accordingly, screw shaft 60*a* advances in a self-tapping fashion through a selected aperture 62, thereafter advances in a self-tapping fashion in engagement with the front and rear walls 64*a*, 64*b* of the crown structure of the sight barrier member, and thereafter punches out a flap 64*c* and passes in a self-tapping fashion through the resulting aperture 64*e*. The combined effect of the self-tapping engagement of the screw shaft with the aperture 62, the side walls 64*a*, 64*b*, and the aperture 64*e* is to firmly and positively position the connector bracket 18 on the vertical wall 32*a*. A further lower bracket 18 is now positioned in the lowermost hole 62, again utilizing a self-tapping screw 60 coacting with barrier member 64 in the manner previously described.

Figure 14:
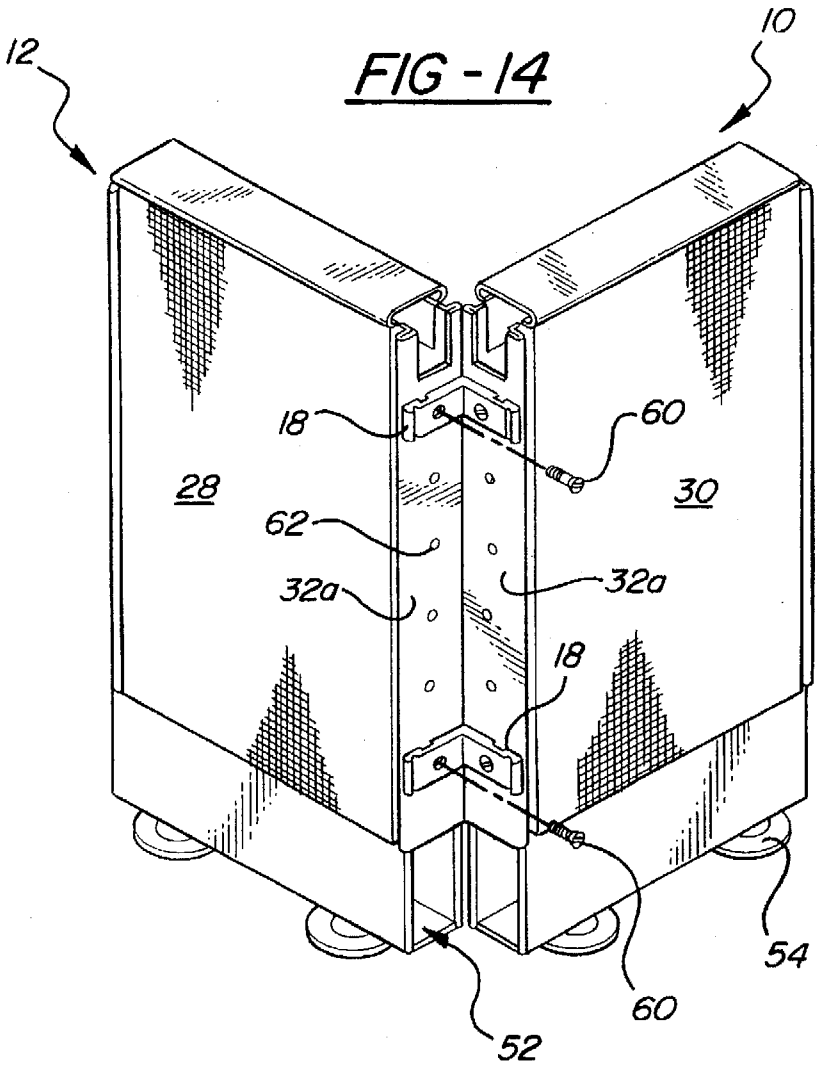
FIGS. 13–28 are instructional views showing the manner in which the wall panels of the invention are secured together in various configurations.

Second panel 12 is now positioned at 90° with respect to first panel 10 (FIG. 14). Screws 60 are installed through apertures 18*s* in the leg portions 18*e* of the upper and lower connector brackets 18 for self-tapping engagement with top and bottom apertures 62, sight barrier side walls 64*a*, 64*b*, and sight barrier apertures 64*c*.

L shaped trim post 20 is now installed (FIGS. 6 and 15) by engaging ball end edge 20*f* in socket grooves 18*j* of the upper and lower connector brackets secured to end wall 32*a* of panel 10 and rotating the trim post about the axis defined by the sockets 18*j* to bring the ball end edge 20*g* into snapping engagement with socket grooves 18*i* in the upper and lower connector brackets secured to end wall 32 of panel 12. The snapping engagement of the ball end edges 20*g* with the sockets 18*i* is facilitated by the flexing movement of the end edge portions 18*p* of the connector brackets as provided by the hinge grooves 18*k* and is further facilitated by the flexing action of the ball edges 20*g* as facilitated by the hinge portion 20*i*. It will be understood that the members are constructed and dimensioned in such a manner as to provide a firm snapping action of ball edges 20*g* into socket grooves 18*i*.

Top caps 42 may now be removed (FIG. 16), a top cap filler 66 positioned on top of the panels 10, 12 at their joined intersection, and the top caps reinstalled to hold the top cap filler 66 in place and complete a joinder of the panels 10 and 12 in right angle configuration.

Figures 15, 16, 17:
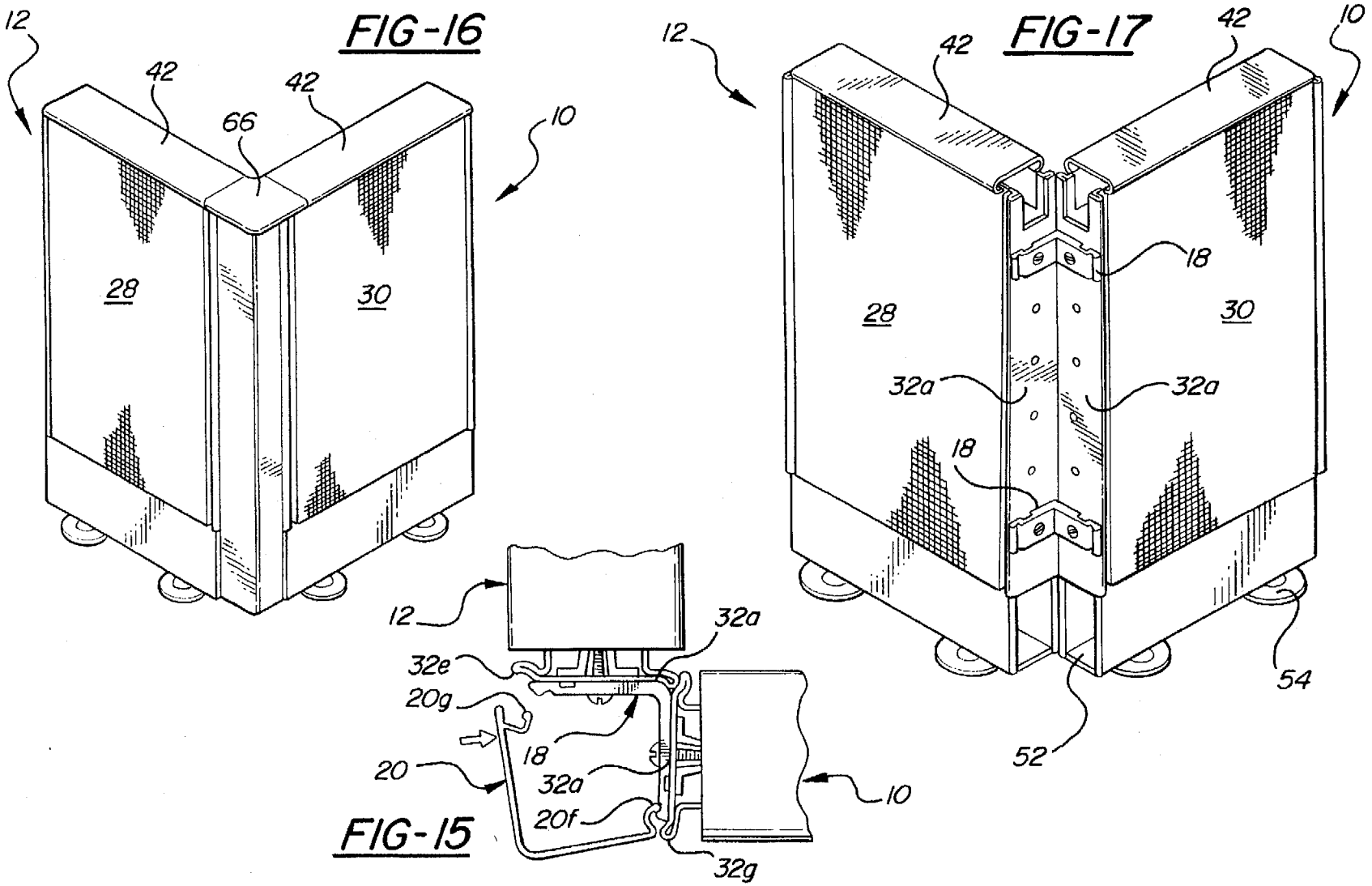
Figure 18:
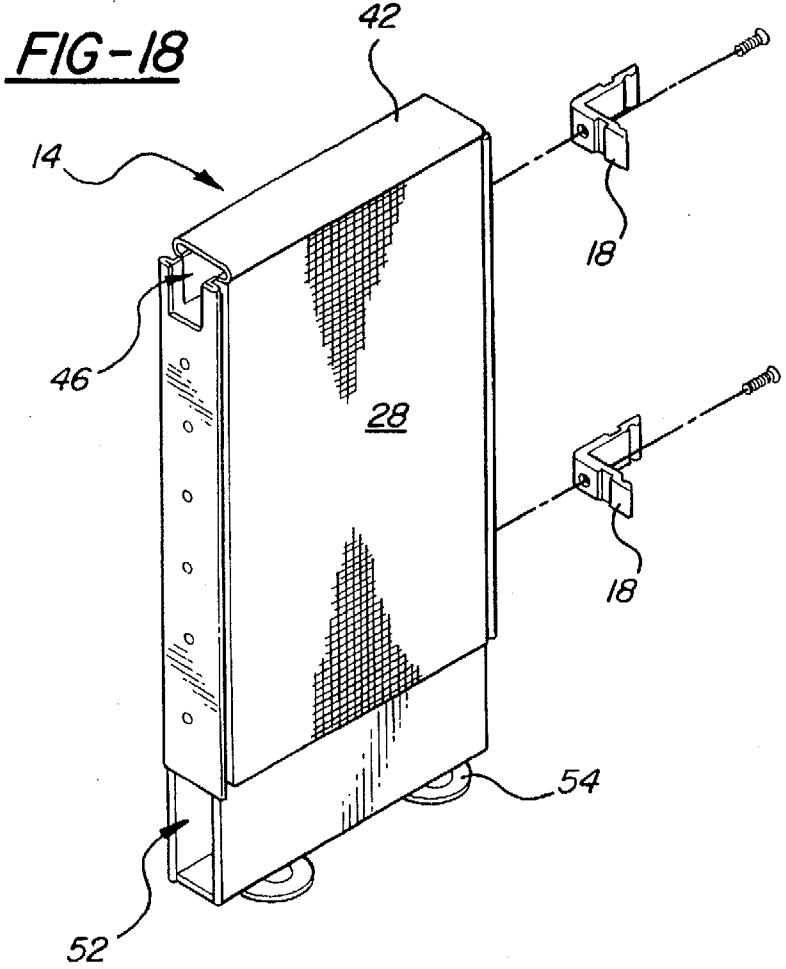
Figures 20, 21, 22:
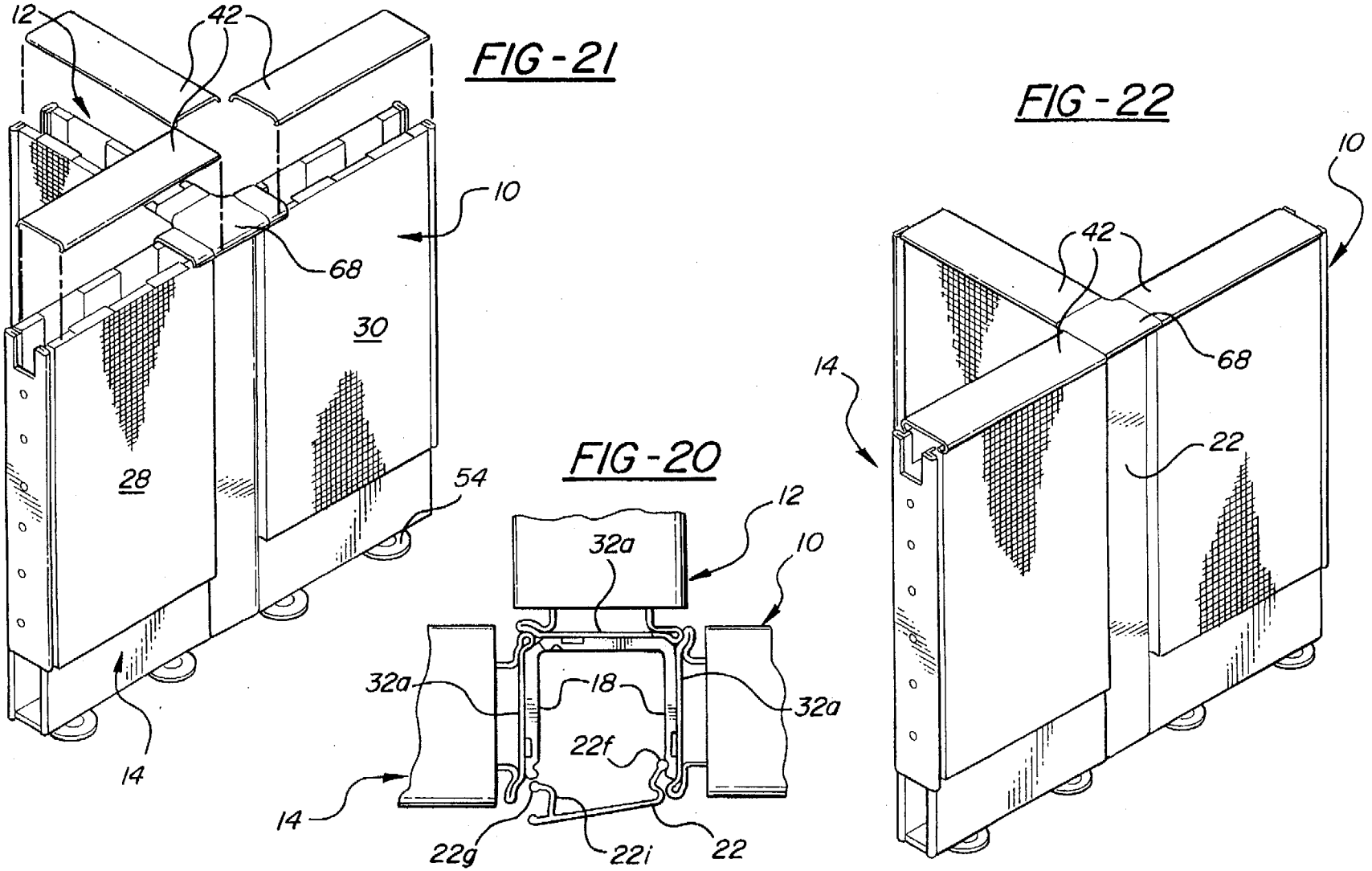
Figure 24:
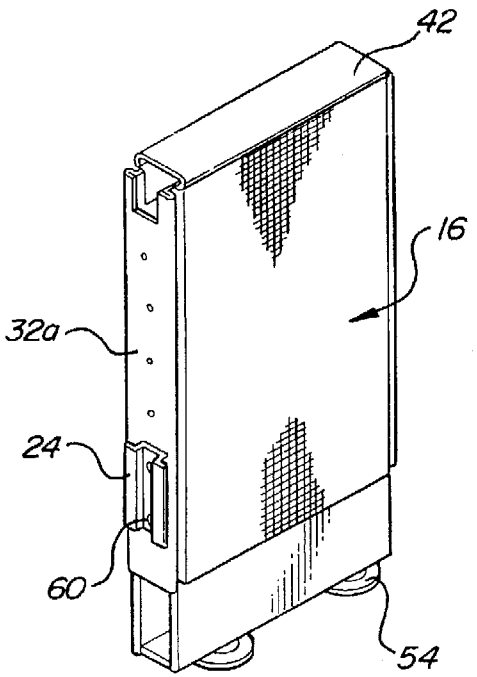
Figure 25:
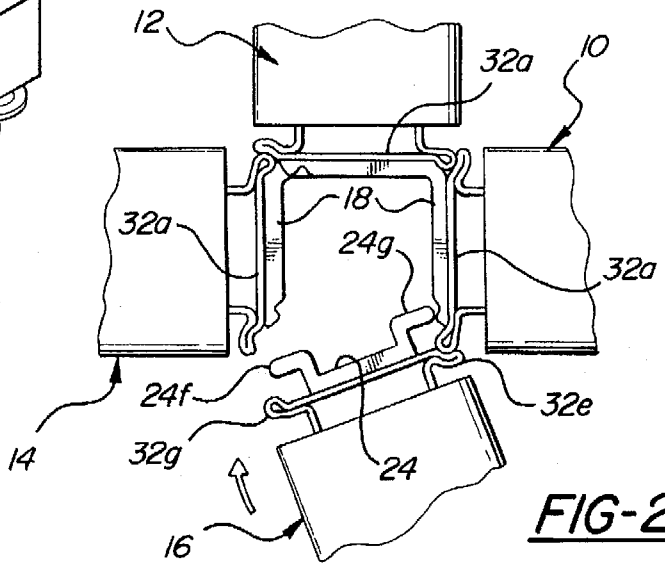
Figure 23:
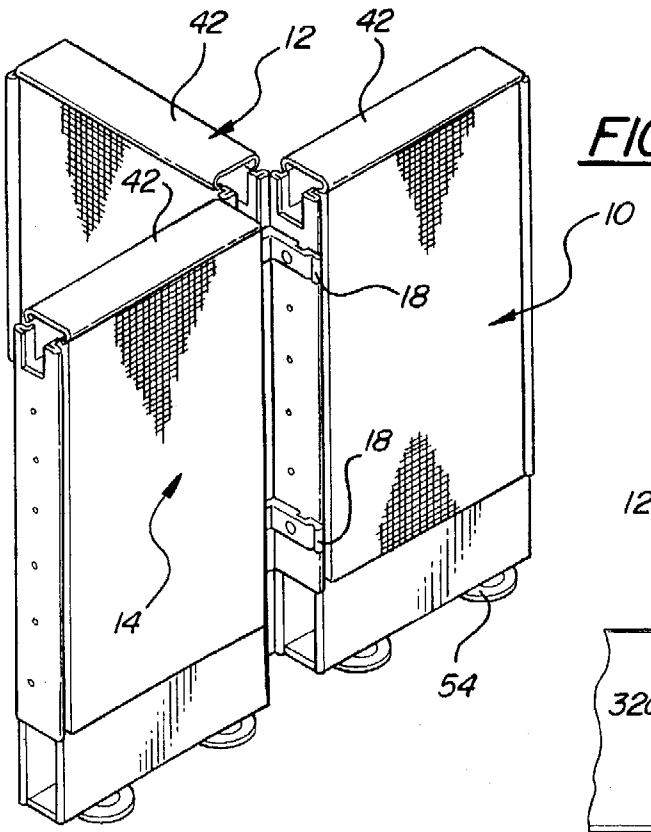

With reference now to the joinder of panels 10, 12 and 14 to form a T configuration (as seen in FIGS. 17–22), panels 10 and 12 are joined together in the manner previously described with respect to FIGS. 13 and 14, whereafter, as seen in FIG. 18, two connector brackets 18 are attached to the tube end wall 32*a* of the third panel 14 at a level that differs from the level at which the connector brackets 18 are secured to the end walls 32*a* of the panels 10 and 12. For example, if the upper and lower connector brackets 18 connecting panels 10, 12 are secured to the top hole 62 and the fifth holes from the top, respectively, the connector brackets 18 secured to the panel 14 may be positioned in the second hole 62 from the top and in the bottom hole 62. Connector brackets are secured to the end wall 32*a* of panel 14 in the self-tapping manner described with respect to the attachment of the connector brackets 18 to the panels 10 and 12, the screws 60 in this case passing through the apertures 18*s* in the legs 18*e* of the upper and lower connector brackets. Panel 14 is now positioned at right angles with respect to panel 12 and in alignment with panel 10, whereafter self-tapping screws 60 are passed through apertures 18*t* in leg portions 18*b* of the upper and lower connector brackets for self-tapping engagement with the second aperture 62 from the top in the end wall 32*a* of panel 12 and the bottom aperture 62 in end wall 32*a*.

Trim post 22 is now installed (FIG. 20) by engaging ball end edge 22*f* in the socket grooves 18*j* of the upper and lower connector bracket attached to panels 10 and 12 whereafter the trim post is swiveled or rotated about the central axis defined by the socket grooves 18*j* to bring the ball end edge 22*g* into snapping coaction with the socket grooves 18*i* defined by the connector bracket 18 secured to the panels 12 and 14. As with the trim post 20, the flexibility provided by the hinge portions 22*i* and by the hinge grooves 18*k* allows the ball end edge 22*g* to snap readily but firmly into place in socket grooves 18*i*. Top caps 42 are now removed (FIG. 21), a top cap filler 68 is installed on top of the joined together panels 10, 12 and 14, and the top caps 42 are reinstalled (FIG. 22) to hold the filler 68 in place.

Figure 19:
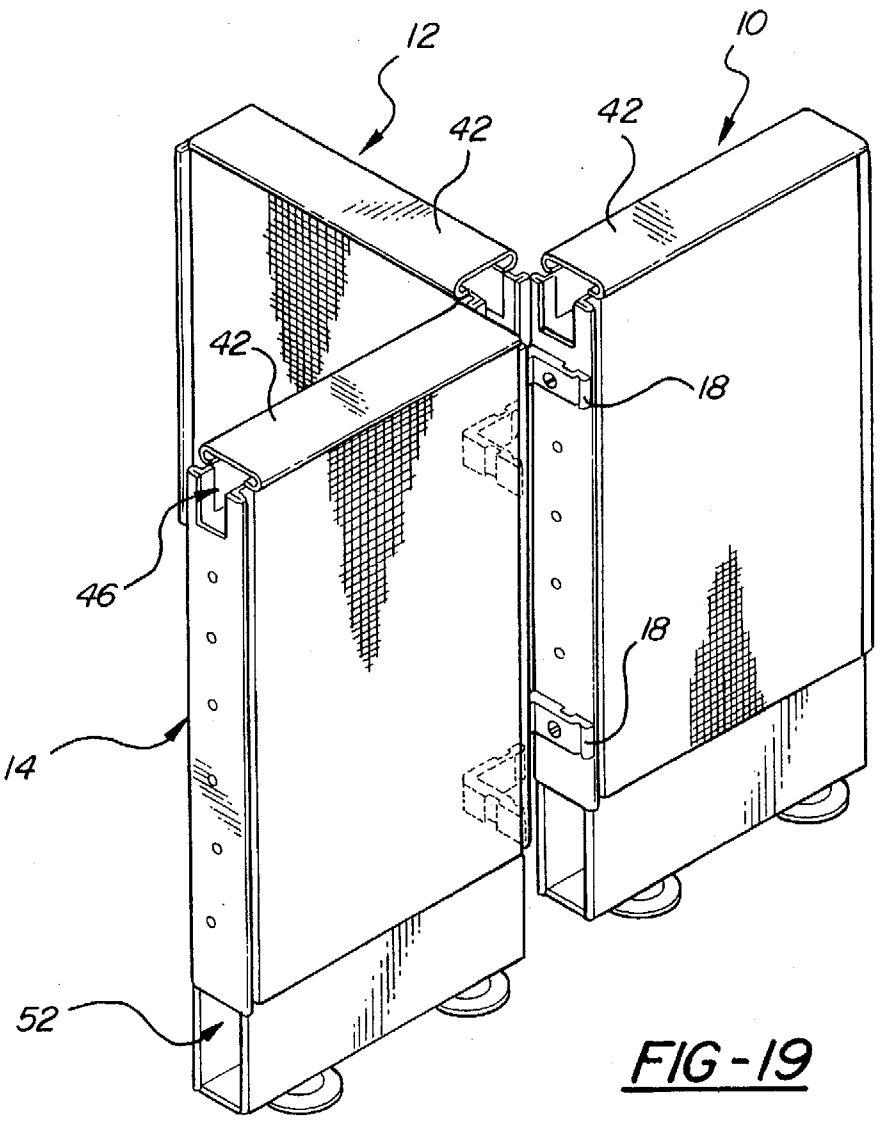

With reference now to the joinder of panels 10, 12, 14 and 16 to form an X configuration (as seen in FIGS. 23–28) panels 10, 12 and 14 are coupled together in the manner previously described with reference to FIGS. 17–19 whereafter (FIG. 24) a retainer bracket 24 is secured to a lower portion of the vertical end wall 32*a* of the fourth panel 16 using two self-tapping screws 60 passing through upper and lower apertures 24*f* in the main body portion 24*a* and self-tappingly through apertures 62 for self-tapping coaction with a sight barrier member 64 in the manner previously described. Thereafter, panel 16 is positioned proximate panels 10, 12, 14, ball end edge 24*g* is positioned in the socket grooves 18*j* defined by the leg portions 18*b* of the connector brackets 18 extending between panels 10 and 12 whereafter the retainer bracket and panel 16 are rotated about the axis defined by the socket grooves 18*j* to bring the other ball end edge 24*f* of the retainer bracket into snapping coaction with the socket grooves 18*i* defined by the leg portions 18*a* of the connector brackets 18 coupling the panels 12 and 14.

Figure 27:
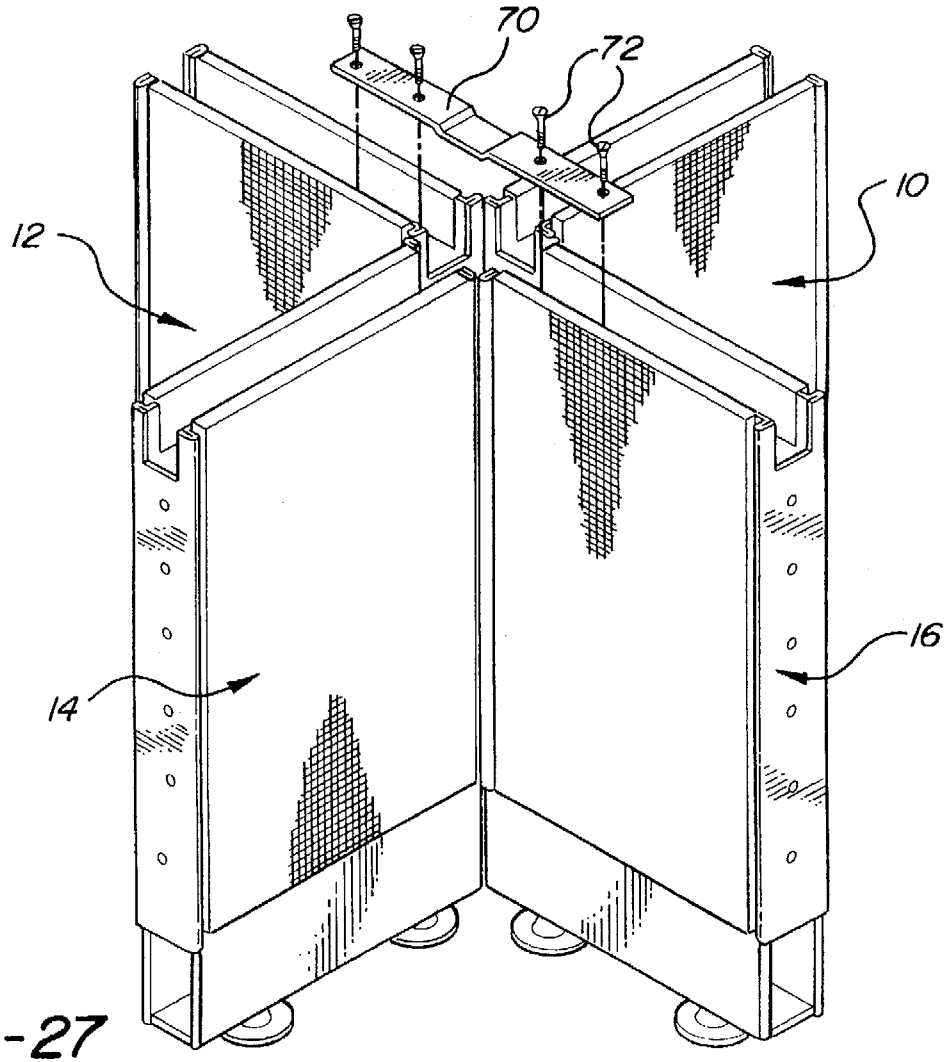
Figure 26:
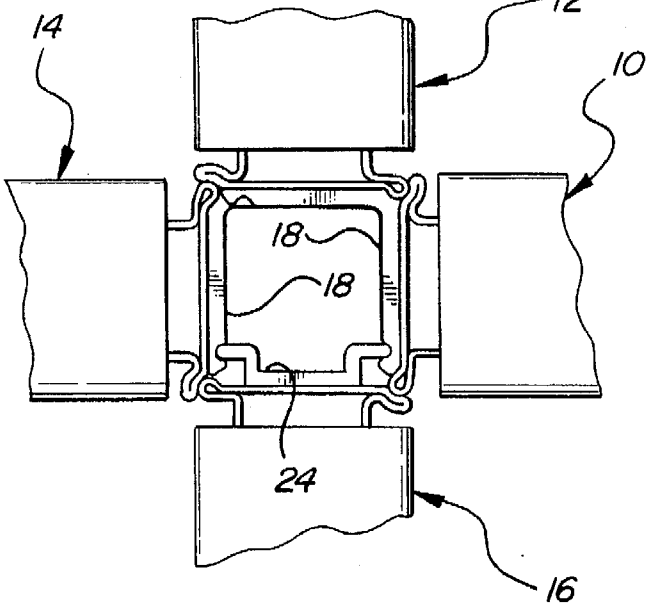

Although, in some installations, the use of a second retainer bracket 24 positioned in spaced relation on the end wall 32*a* of panel 16 above the first bracket 24 will be sufficient to provide satisfactory coupling of the panel 16 to the panels 10, 12 and 14, in some installations vertically spaced retainer brackets 24 do not provide satisfactory coupling of the panel 16 to the panels 10, 12 and 14. In these installations, and as seen in FIG. 27, a long straight plate connector 70 is positioned in the aligned pathways 46 at the top of the panels 12 and 16 and secured to the upper wall of the upper tube members 38 of the framework of each panel utilizing screws 72 self-tapping in apertures 39*a* in tapping plates 39 positioned at the tops of the tubes 32 of panels 12 and 16, whereafter a filler cap 74 is positioned over the intersection of the panels and top caps 42 are installed to hold the filler cap in place.

A similar (but shorter) plate connector 70 may be utilized to secure two panels together in a straight abutting configuration with screws 72 again self-tappingly engaging apertures 39*a* in tapping plates 39 positioned at the tops of the tubes 32 of the abutting panels.

In each of the described installations, it will be seen that a concave surface 32*f* defined at one edge of a vertical end wall 32*a* coacts with a convex surface 32*h* defined along the other edge of an end wall 32*a* to prevent light leakage between adjacent panels. Specifically, in each installation, the curvatures of the edge portions of the end walls are such that the outer convex surface of the portion 32*g* of one panel conforms to and seats within the inner concave surface of the portion 32*e* of an adjacent panel. Further, the various connector assembly members will be seen to be arranged in a manner such that the extension portions 20*j* and 22*j* of the trim posts 20, 22 in every instance confront a concave fold 32*e* (rather than a convex fold 32*g*) of the end wall of the adjacent panel so that the extension portions 20*j*, 22*j* coact with the concave folds to minimize light leakage. It will further be seen that, in assembled relation, the beveled edges 18*r* of the connector brackets conform to the inner configuration of the convex folds 32*g* received in the concave folds 32*e*.

The invention will be seen to overcome the disadvantages of the wall panels of the prior art. Specifically, the invention, by utilizing identical connector brackets 18 in each installation, reduces the inventory requirements with respect to assembling the wall panels in various configurations. Further, the invention coupling arrangement, in most installations, preserves an open vertical passage between the end edges of the assembled panels to facilitate the passage of telecommunications cables downwardly from the upper pathways 46 and/or the passage of power cables upwardly from the lower pathways 52 to simplify the routing of the electrical communications to the various outlets provided on or adjacent the panels.

Whereas a preferred embodiment of the invention has been illustrated and described in detail, it will be apparent that various changes may be made in the disclosed embodiment without departing from the scope or spirit of the invention. For example, while the invention has been described with respect to the coupling together of panels of equal height, it will be apparent that the invention is equally applicable to the coupling of panels of uneven height. It will also be apparent that in installations terminating in a wall panel exposing a naked end edge, the invention may be utilized to secure brackets (employing socket grooves) in self-tapping manner to the naked end edge utilizing the apertures 62 whereafter a planar cover plate (employing ball end edges) may be snapped in position over the brackets in order to cosmetically finish the end edge of the panel.

What is claimed:

1. A connector assembly for use in releasably attaching upstanding wall panels together in various relative configurations, the assembly including:

upper and lower connector brackets, each bracket having an L configuration defining first and second leg portions adapted for respective attachment to vertical end edges of first and second wall panels arranged in an L configuration, each leg portion having an inside face and an outside face and defining a free vertical end edge, each leg portion defining a vertical socket groove proximate the free end edge of the leg portion opening in the inside face of the leg portion; and a further connector assembly member having a vertically elongated main body portion defining vertical edges and a vertical flange portion at each edge of the main body portion, each flange portion defining a ball end edge sized to fit in a socket groove of the connector brackets.

2. A connector assembly according to claim 1 wherein the further connector assembly member comprises a vertical trim post of L cross-sectional configuration sized to position the respective ball end edges in the respective vertical socket grooves of the connector brackets and coacting with the connector brackets to define a vertical passage proximate the end edges of the first and second wall panels.

3. A connector assembly according to claim 1 wherein each leg portion of each bracket further includes a vertical hinge groove in the outside face of the leg portion inboard of the socket groove, the vertical hinge groove defining a hinge portion inboard of the socket groove to allow flexing of an outboard end edge of the leg portion to facilitate entry of a ball end edge of a flange portion of the further connector assembly member into the respective socket groove with a snap action.

4. A connector assembly according to claim 3 wherein each leg portion of each bracket further defines an aperture inboard of the hinge groove to facilitate attachment of the leg portion to the vertical end edge of a respective wall panel.

5. A connector assembly according to claim 1 wherein:

the upper and lower connector brackets comprise a first set of upper and lower connector brackets;

the assembly further includes a second set of upper and lower connector brackets identical to the first set, the first and second leg portions of the second set of connector brackets adapted for respective attachment to the vertical end edge of the second wall panel and a vertical end edge of a third wall panel coacting with the first and second panels to form a T configuration, an intended attachment location of the leg portions of the second set of connector brackets to the end edge of the second wall panel being at a different vertical height on the end edge of the second wall panel than an intended attachment location of the leg portions of the first set of connector brackets on the end edge of the second wall panel;

the further connector assembly member comprises a generally planar vertical trim post sized to allow the ball end edges of the flange portions of the post to fit respectively in socket grooves in the leg portions of the first set of connector brackets attached to the end edge of the first panel and in socket grooves in the leg portions of the second set of connector brackets attached to the end edge of the third panel;

the end edges of the first, second and third wall panels coact with the vertical trim post to define a vertical passage.

6. An assembly according to claim 1 wherein:

each leg portion defines a hinge section inboard of the respective socket groove to facilitate flexing of the end edge of the leg portion;

each vertical flange portion of the further connector assembly member is connected to the main body portion by a hinge portion to facilitate flexing of the flange portion relative to the main body portion;

the connector assembly members are releasably secured together by positioning one ball end edge of the further connector assembly member in the socket grooves of the first leg portions of the upper and lower connector brackets and rotating the further connector assembly member to bring another ball end edge into coaction with other socket grooves;

the flexing of the end edge portion and the flange portion enabling the other ball end edge to move into seating engagement with the other socket grooves with a snap action.

7. A wall panel assembly including a plurality of upstanding wall panels adapted to be releasably secured together in various relative configurations, the assembly including:

first and second upstanding wall panels arranged with a vertical end edge of the first panel positioned in right angle relation to and proximate a vertical end edge of the second panel to form an L end edge presentation;

upper and lower connector brackets, each bracket having an L configuration defining first and second leg portions, each leg portion having an outside face attached to the end edge of a respective wall panel and an inside face and defining a free vertical end edge, each leg portion defining a vertical socket groove in the inside face of the leg portion proximate the free end edge of the leg portion; and a further assembly member having a vertically elongated main body portion defining vertical edges and a vertical flange portion at each edge of the main body portion, each flange portion defining a ball end edge sized to fit in a socket groove of the connector brackets.

8. A wall panel assembly according to claim 7 wherein the further connector assembly member comprises a vertical trim post of L configuration having respective ball end edges fitted in the respective vertical socket grooves of the connector brackets and coacting with the connector brackets to define a vertical passage proximate the end edges of the first and second wall panels.

9. A wall panel assembly according to claim 7 wherein each leg portion of each bracket further defines a vertical hinge groove in the outside face of the leg portion inboard of the socket groove, the vertical hinge groove defining a hinge portion inboard of the socket groove to allow flexing of an outboard end edge of the leg portion to facilitate entry of a ball end edge of a flange portion of the further connector assembly member into the respective socket groove with a snap action.

10. A wall panel assembly according to claim 9 wherein each leg portion of each bracket further defines an aperture inboard of the hinge groove to facilitate attachment of the leg portion to the vertical end edge of a respective wall panel.

11. A wall panel assembly according to claim 7 wherein:

the assembly further includes a third upstanding wall panel arranged with end edges of the three panels forming a U end edge presentation;

the upper and lower connector brackets comprise a first set of upper and lower connector brackets;

the assembly further includes a second set of upper and lower connector brackets identical to the first set, the first and second leg portions of the second set of connector brackets being attached respectively to the vertical end edge of the second wall panel and to the vertical end edge of the third wall panel, an attachment location of the leg portions of the second set of connector brackets to the end edge of the second wall panel being at a different vertical height on the end edge of the second wall panel than an attachment location of the leg portions of the first set of connector brackets on the end edge of the second wall panel; and the further connector assembly member comprises a generally planar vertical trim post sized to allow the ball end edges of the flange portions of the trim post to fit respectively in socket grooves in the leg portions of the first set of connector brackets attached to the end edge of the first panel and in socket grooves in the leg portions of the second set of connector brackets attached to the end edge of the third panel.

12. A wall panel assembly according to claim 7 wherein:

each leg portion defines a hinge section inboard of the respective socket groove to facilitate flexing of the end edge of the leg portion;

each vertical flange portion of the further connector assembly member is connected to the main body portion by a hinge portion to facilitate flexing of the flange portion relative to the main body portion; and the connector assembly members are releasably secured together by positioning one ball end edge of the further connector assembly member in the socket grooves of the first leg portions of the upper and lower connector brackets and rotating the further connector assembly member to bring the other ball end edge into coaction with other socket grooves, the flexing of the end edge portions and the flange portions enabling the other ball end edge to move into seating engagement with the other socket grooves with a snap action.

13. A wall panel assembly according to claim 7 wherein:

the further connector assembly member comprises a retainer bracket;

the assembly further includes third and fourth upstanding wall panels each having an end edge, the four panels being arranged in an X configuration;

the upper and lower connector brackets comprise a first set of upper and lower connector brackets;

the assembly further includes a second set of upper and lower connector brackets identical to the first set, the first and second leg portions of the second set of connector brackets being attached respectively to the vertical end edge of the second wall panel and to the vertical end edge of the third wall panel, an attachment location of the leg portions of the second set of connector brackets to the end edge of the second wall panel being at a different vertical height on the end edge of the second wall panel than an attachment location of the leg portions of the first set of connector brackets on the end edge of the second wall panel; and the retainer bracket is attached to the end edge of the fourth panel with the ball end edges of the flange portions of the retainer bracket fitted respectively in socket grooves in the leg portions of the first set of connector brackets attached to the end edge of the first panel and in socket grooves in the leg portions of the second set of connector brackets attached to the end edge of the third panel.

14. A method of forming a wall panel assembly comprising the steps of:

providing first and second upstanding wall panels each having a vertical end edge;

providing a first set of upper and lower connector brackets, each bracket having an L configuration defining first and second leg portions, each leg portion having an outside face and an inside face and defining a free vertical end edge, each leg portion defining a vertical socket groove proximate the free end edge of the leg portion opening in the inside face of the leg portion;

attaching the first leg portions of the upper and lower connector brackets to the end edge of the first wall panel at vertically spaced locations;

positioning the second panel at right angles to the first panel;

attaching the second leg portions of the upper and lower connector brackets to the end edge of the second panel at vertically spaced locations;

providing a further assembly member having a vertically elongated main body portion defining vertical edges and a vertical flange portion at each edge of the main body portion with each flange portion defining a ball end edge sized to fit in a socket groove of the connector brackets; and positioning the further assembly member with one ball end edge seating in the socket grooves of the first leg portions.

15. A method according to claim 14 wherein:

the further connector assembly member comprises a vertical trim post of L cross-sectional configuration; and the method comprises, after seating the one ball end edge in the socket grooves of the first leg portions, rotating the trim post to bring the other ball end edge into seating engagement with the socket grooves of the second leg portions.

16. A method according to claim 14 wherein:

the further connector assembly member comprises a generally planar vertical trim post;

the method includes the further steps of providing a third wall panel having a vertical end edge, providing a second set of upper and lower connector brackets identical to the first set of upper and lower connector brackets, attaching the first leg portions of the second set of connector brackets to an end edge of the third wall panel, positioning the third wall panel so that the end edges of the three panels present a U configuration, attaching the second leg portions of the further connector brackets to the end edge of the second wall panel at locations spaced from the second leg portions of the first set of upper and lower connector brackets, fitting one ball end edge of the trim post into the socket grooves of the first leg portions of the first set of connector brackets and fitting the other ball end edge of the trim post into the socket grooves of the first leg portions of the second set of connector brackets.

17. A method according to claim 16 wherein the first ball end edge of the trim post is fitted in the socket grooves of the first leg portions of the first connector brackets whereafter the trim post is rotated to bring the other ball end edge of the trim post into seating engagement with the socket grooves of the first leg portions of the second connector brackets.

18. A method according to claim 14 wherein:

the further connector assembly comprises a retainer bracket;

the method includes the further steps of providing third and fourth upstanding wall panels, each having a vertical end edge, providing a second set of upper and lower connector brackets identical to the first set of upper and lower connector brackets, attaching the first leg portions of the second set of connector brackets to an end edge of the third wall panel, positioning the third panel so that the end edges of the three panels present a U configuration, attaching the second leg portions of the further connector brackets to the end edge of the second wall panel at locations spaced from the second leg portions of the first set of upper and lower connector brackets, attaching the main body portion of the retainer bracket to the end edge of the fourth panel, fitting one ball end edge of the retainer bracket into the socket grooves of the first leg portions of the first set of connector brackets and fitting the other ball end edge of the retainer bracket into the socket grooves of the first leg portions of the second set of connector brackets.

* * * * *